US009585445B2

(12) United States Patent
Qian et al.

(10) Patent No.: US 9,585,445 B2
(45) Date of Patent: Mar. 7, 2017

(54) MAGNETIC BUCKLE

(71) Applicant: Apple Inc., Cupertino, CA (US)

(72) Inventors: Amy Qian, Cupertino, CA (US); Bartley K. Andre, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 24 days.

(21) Appl. No.: 14/822,919

(22) Filed: Aug. 11, 2015

(65) Prior Publication Data

US 2016/0037879 A1 Feb. 11, 2016

Related U.S. Application Data

(60) Provisional application No. 62/035,561, filed on Aug. 11, 2014.

(51) Int. Cl.

| | |
|---|---|
| ***A44C 5/20*** | (2006.01) |
| ***A41F 1/00*** | (2006.01) |
| ***A44B 11/25*** | (2006.01) |

(52) U.S. Cl.

CPC ..... *A44C 5/2071* (2013.01); *A41F 1/002* (2013.01); *A44B 11/258* (2013.01); *A44C 5/2052* (2013.01); *A44D 2203/00* (2013.01); *Y10T 24/32* (2015.01); *Y10T 24/4026* (2015.01); *Y10T 24/4782* (2015.01)

(58) Field of Classification Search

CPC ..... A44C 5/2071; A44C 5/2052; A41F 1/002; A44B 11/258; A44D 2203/00; Y10T 24/32; Y10T 24/4782; Y10T 24/4026

See application file for complete search history.

(56) References Cited

U.S. PATENT DOCUMENTS

| | | | |
|---|---|---|---|
| 3,579,159 | A | 5/1971 | Posey |
| 3,815,066 | A | 6/1974 | Vinal |
| 3,873,957 | A | 3/1975 | Wurscher et al. |

(Continued)

FOREIGN PATENT DOCUMENTS

| | | |
|---|---|---|
| CN | 2497586 | 7/2002 |
| CN | 1395896 | 2/2003 |

(Continued)

OTHER PUBLICATIONS

International Search Report and Written Opinion, PCT/US2015/044393, 11 pages, Oct. 14, 2015.

*Primary Examiner* — Robert J Sandy

(74) *Attorney, Agent, or Firm* — Sterne, Kessler, Goldstein & Fox P.L.L.C.

(57) ABSTRACT

A clasp for securing a first strap with a second strap includes a first clasp portion having a first frame member and a first set of magnets movable from a first to a second position, the first clasp portion adapted to be attached with the first strap; and a second clasp portion adapted to selectively connect with the first clasp portion, the second frame clasp portion having second frame member and a second set of magnets positioned in a fixed location within the second clasp portion, the second set of magnets positioned adjacent the first set of magnets when the second clasp portion is connected with the first clasp portion, the second clasp portion adapted to be attached with the second strap. When the first and second set of magnets create an attractive magnetic force therebetween in the first position and a repulsive magnetic force therebetween in the second position.

20 Claims, 9 Drawing Sheets

(56) References Cited

U.S. PATENT DOCUMENTS

| | | | | |
|---|---|---|---|---|
| 3,906,417 | A | 9/1975 | Serras-Paulet | |
| 3,938,642 | A | 2/1976 | Van Rumpt et al. | |
| 4,054,944 | A | 10/1977 | Lau | |
| 4,280,214 | A | 7/1981 | Kunii et al. | |
| 4,453,148 | A | 6/1984 | Norakidze et al. | |
| 4,868,530 | A | 9/1989 | Ahs | |
| 4,941,236 | A | 7/1990 | Sherman et al. | |
| 5,076,623 | A | 12/1991 | Richards | |
| 5,323,516 | A | 6/1994 | Hartmann | |
| 5,349,725 | A | 9/1994 | Levy | |
| 5,367,891 | A * | 11/1994 | Furuyama | A44C 5/2057 24/303 |
| 5,889,737 | A | 3/1999 | Alameh et al. | |
| 5,977,888 | A | 11/1999 | Fujita et al. | |
| 6,050,931 | A | 4/2000 | Russell | |
| 6,598,271 | B2 | 7/2003 | Nire | |
| 6,598,272 | B2 | 7/2003 | Nire | |
| 6,981,391 | B2 * | 1/2006 | Suzuki | A44C 5/2076 24/303 |
| 7,043,740 | B2 | 5/2006 | Chen et al. | |
| 7,152,282 | B2 * | 12/2006 | Costa | A44C 5/20 24/303 |
| 7,308,737 | B2 * | 12/2007 | Saitoh | E05B 47/0038 24/303 |
| 7,496,994 | B1 | 3/2009 | Headley et al. | |
| 7,667,623 | B2 | 2/2010 | Soh et al. | |
| 7,708,456 | B2 | 5/2010 | Kraus et al. | |
| 7,889,036 | B2 * | 2/2011 | Fiedler | H01F 7/0263 292/251.5 |
| 8,467,270 | B2 | 6/2013 | Gossweiler, III et al. | |
| 8,505,334 | B2 | 8/2013 | Niikura | |
| 8,717,132 | B2 | 5/2014 | Lancaster-Larocque | |
| 8,937,520 | B2 | 1/2015 | Kan | |
| 8,957,751 | B2 | 2/2015 | Fullerton et al. | |
| 8,978,213 | B2 | 3/2015 | Hayton | |
| 8,985,410 | B2 | 3/2015 | Wishart | |
| 8,994,827 | B2 | 3/2015 | Mistry et al. | |
| 8,997,318 | B2 | 4/2015 | Nicolas et al. | |
| 9,089,193 | B2 | 7/2015 | Casini | |
| 9,141,086 | B1 | 9/2015 | Rohrbach | |
| 2002/0104151 | A1 | 8/2002 | Rauscher | |
| 2003/0229974 | A1 | 12/2003 | Zemer et al. | |
| 2006/0257190 | A1 | 11/2006 | Chiang | |
| 2011/0048069 | A1 | 3/2011 | Komatsu | |
| 2013/0326790 | A1 | 12/2013 | Cauwels et al. | |
| 2014/0033482 | A1 | 2/2014 | Fullerton et al. | |
| 2014/0077910 | A1 | 3/2014 | Chaizy | |
| 2016/0037875 | A1 | 2/2016 | Rohrbach | |
| 2016/0037896 | A1 | 2/2016 | Kosoglow et al. | |
| 2016/0037897 | A1 | 2/2016 | Bataillou et al. | |
| 2016/0042897 | A1 | 2/2016 | Qian | |

FOREIGN PATENT DOCUMENTS

| | | |
|---|---|---|
| CN | 1794931 | 6/2006 |
| CN | 101657120 | 2/2010 |
| CN | 201440767 | 4/2010 |
| CN | 201683167 | 12/2010 |
| CN | 101384975 | 3/2011 |
| CN | 202154152 | 3/2012 |
| CN | 102481034 | 5/2012 |
| CN | 202233407 | 5/2012 |
| CN | 202533728 | 11/2012 |
| CN | 103164044 | 6/2013 |
| CN | 203314250 | 12/2013 |
| CN | 103504731 | 1/2014 |
| CN | 203469237 | 3/2014 |
| CN | 204838302 | 12/2015 |
| DE | 2323058 | 11/1974 |
| EP | 1980170 | 10/2008 |
| EP | 2532262 | 12/2012 |
| GB | 2099762 | 12/1982 |
| JP | H10165211 | 6/1998 |
| JP | 2004166895 | 6/2004 |
| JP | 2011078524 | 4/2011 |
| KR | 1020050105950 | 4/2006 |
| WO | WO2007/114631 | 10/2007 |
| WO | WO2013090198 | 6/2013 |
| WO | WO03/056956 | 7/2013 |
| WO | WO2015/028044 | 3/2015 |

* cited by examiner

MAGNETIC BUCKLE

CROSS-REFERENCE TO RELATED APPLICATION

This application is a nonprovisional patent application of and claims the benefit to U.S. Provisional Patent Application No. 62/035,561, filed Aug. 11, 2014 and titled "Magnetic Buckle," the disclosure of which is hereby incorporated herein by reference in its entirety.

FIELD

This disclosure relates, in general, to buckles and clasps that are held together magnetically.

BACKGROUND

Buckles and clasps are used to secure items to a user's body, such as a clasp for a watch band to hold a watch on the wrist of a wearer.

Many conventional clasps have a length adjustment that requires the wearer to pass a strap with holes through a rotatable pin member that passes through one of the holes. Typically, the user has to perform this process each time the user wears the item or removes the item from their wrist.

SUMMARY

According to one broad aspect of an embodiment of the present disclosure, disclosed herein is a clasp (also interchangeably referred to herein as a buckle) for securing a first strap with a second strap. In one example, the clasp may include a first clasp portion; a first set of magnets movable within the first clasp portion between a first position and a second position, the first clasp portion adapted to be attached with the first strap; a second clasp portion adapted to selectively connect with the first clasp portion; and a second set of magnets positioned within the second clasp portion and adjacent the first set of magnets when the second clasp portion is connected with the first clasp portion, the second clasp portion adapted to be attached with the second strap. When the first set of magnets is in the first position, the first and second set of magnets may create an attractive magnetic force therebetween.

In one example, when the first set of magnets is in the second position, the first and second set of magnets create a repulsive magnetic force therebetween.

The clasp may also include at least one biasing magnet positioned within the first clasp portion, adjacent to the first set of magnets, wherein the biasing magnet creates an additional attractive magnetic force that biases the first set of magnets into said first position.

In one example, the first set of magnets includes a plurality of magnets of alternating polarities positioned adjacent to one another, and the second set of magnets includes a plurality of magnets of alternating polarities positioned adjacent to one another.

The clasp may also include at least one button member positioned within the first clasp portion, the button member adapted to receive contact from a user. In one example, the button may include a latch that selectively secures to a portion of the second clasp portion. The first set of magnets may be positioned within or connected with the at least one button member.

In another example, the clasp may also include a first set of corner magnets positioned within the first clasp portion; and a second set of corner magnets positioned within the second clasp portion in a position that such that when the first and second clasp portions are connected together, the first and second set of corner magnets create an additional attractive magnetic force therebetween. In this embodiment, when the first set of magnets is in the second position, the first and second set of magnets create a repulsive magnetic force therebetween that is greater than said additional attractive magnetic force between the first and second set of corner magnets.

In one embodiment, the first and second straps that are adapted to be connected with the clasp may also be connected with a wearable electronic device.

According to another broad aspect of another embodiment of the present disclosure, disclosed herein is a buckle. In one example, the buckle may include a first buckle portion having a first set of magnets positioned within the first buckle portion; and a second buckle portion having a second set of magnets positioned within the second buckle portion, wherein the first and second set of magnets are adapted to attract the first and second buckle portions together via an attractive magnetic force. The first buckle portion may also include one or more slideable magnets movable between at least a first position and a second position. The second buckle portion may also include one or more magnets in a fixed location within the second buckle portion, the one or more magnets adapted to magnetically interact with the one or more slideable magnets of the first buckle portion.

In one example, when the slideable magnets are in the first position, there is an additional attractive magnetic force between the slideable magnets and the one or more magnets in a fixed location within the second buckle portion. When the slideable magnets are in the second position, there is a repulsive magnetic force between the slideable magnets and the one or more magnets in a fixed location within the second buckle portion. In one example, the repulsive magnetic force is greater than the attractive magnetic force, thereby permitting the first and second buckle portions to be physically separated.

The buckle may also include at least one biasing magnet positioned within the first buckle portion adjacent to the one or more slideable magnets, wherein the biasing magnet creates a magnetic force that biases the slideable magnets into said first position.

According to another broad aspect of another embodiment of the present disclosure, disclosed herein is a method of forming a buckle. In one example, the method may include forming a first buckle portion with a first set of magnets movable within the first buckle portion between a first position and a second position; forming a second buckle portion with a second set of magnets positioned in a fixed location within the second buckle portion; and biasing the first set of magnets toward the first position, such that when the first set of magnets is in the first position, the first and second set of magnets create a first attractive magnetic force therebetween.

In another example, the method may also include positioning a third set of magnets in the first buckle portion; and positioning a fourth set of magnets in the second buckle portion; wherein the third and fourth set of magnets create a second attractive magnetic force between the first and second buckle portions. In one example, when the first set of magnets is in the second position, a repulsive magnetic force is created between the first set of magnets and the second set of magnets, the repulsive magnetic force being greater than the second attractive magnetic force.

Other embodiments of the disclosure are described herein. The features, utilities and advantages of various embodiments of this disclosure will be apparent from the following more particular description of embodiments as illustrated in the accompanying drawings.

DETAILED DESCRIPTION

Disclosed herein are various examples of buckles (also interchangeably referred to herein as clasps) that allow quick attachment and quick release from a wearer's body, while maintaining a length adjustment as set by the wearer. In accordance with an embodiment of the present disclosure, once an appropriate strap length has been set in the buckle, the buckle retains that setting and can be attached or removed from the wearer without having to adjust or re-set the length. In one example embodiment of the present disclosure, an arrangement of a plurality of magnets are utilized and provide various magnetic attractive and repulsive forces which aid in the operation of the buckle. Various embodiments of the present disclosure are described herein.

Figure 1:
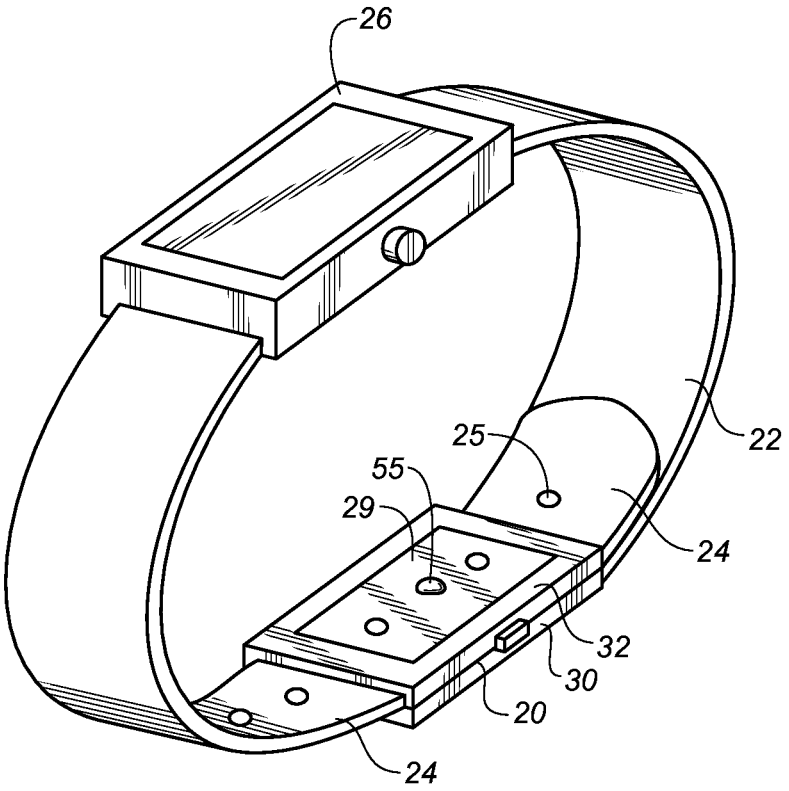
FIG. 1 illustrates a perspective view of an example of a buckle coupled with a wearable electronic device through straps, in accordance with one embodiment of the present disclosure.
Figure 2:
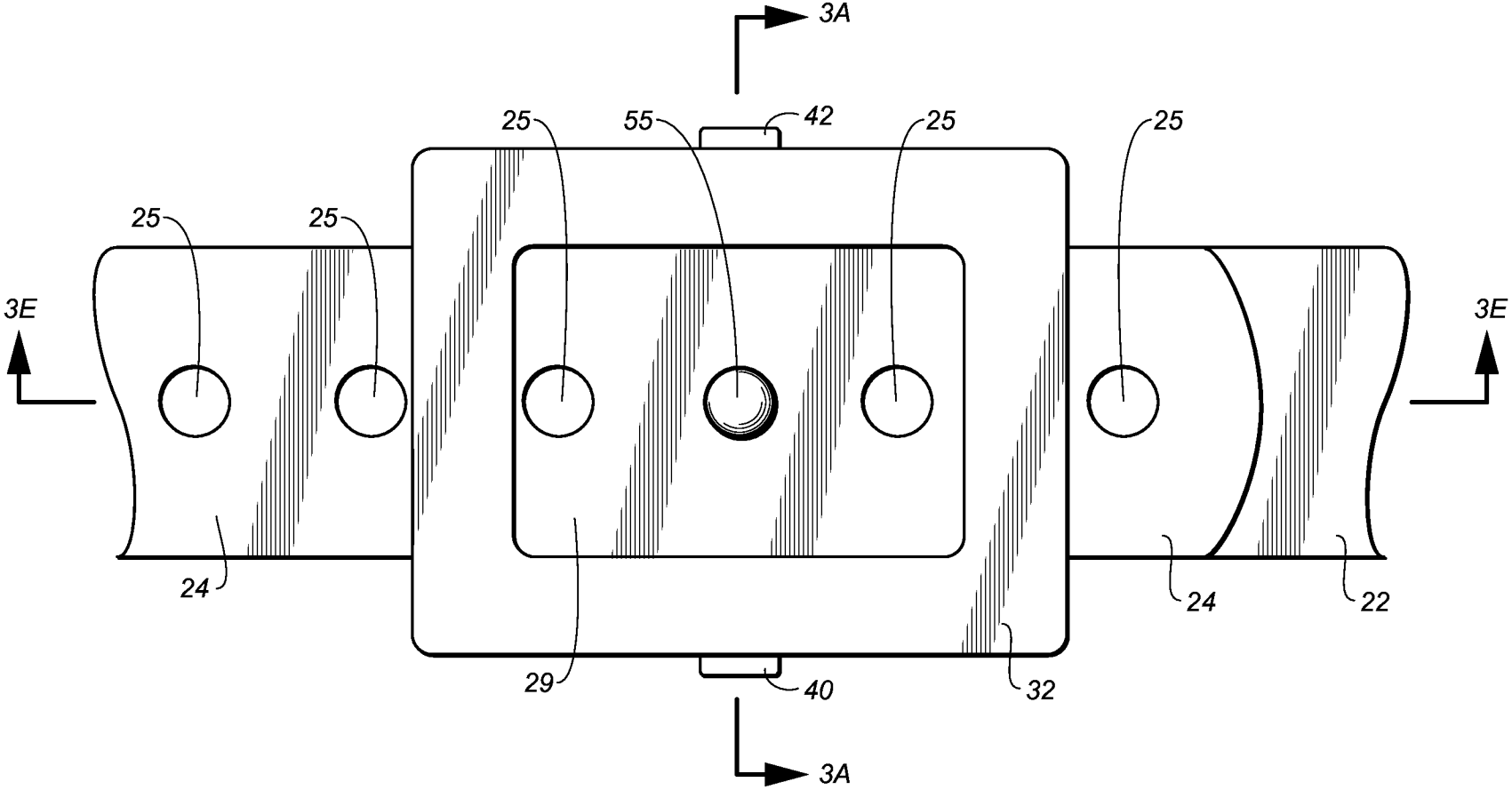
FIG. 2 illustrates a top view of the buckle, in accordance with one embodiment of the present disclosure.

FIGS. 1-2 illustrate an example of a buckle or clasp 20 which is used to securely couple a first strap (or strap portion) 22 with a second strap (or strap portion) 24. Strap 24 may include a plurality of holes 25 defined along a portion of strap 24, wherein the holes may be used to adjust or fit the combined straps 22, 24 and buckle 20 to a particular wearer.

In the example of FIG. 1, buckle 20 may be utilized to connect straps 22, 24 about a wearer's wrists, leg, ankle, arm, neck, waist or other portion of their body, wherein straps 22, 24 may be connected with a wearable device 26 such as a watch, computing device, wireless device, or other wearable device.

Buckle 20 may be made of any conventional materials, such as, but not limited to, metal, rubber, plastic, composite materials, or any other material or combination of materials as desired. Straps 22, 24 can also be made of any conventional materials, such as, but not limited to, cloth, leather, plastic, rubber, metal, composite materials, or any other material or combinations of materials as desired.

Figure 3A:
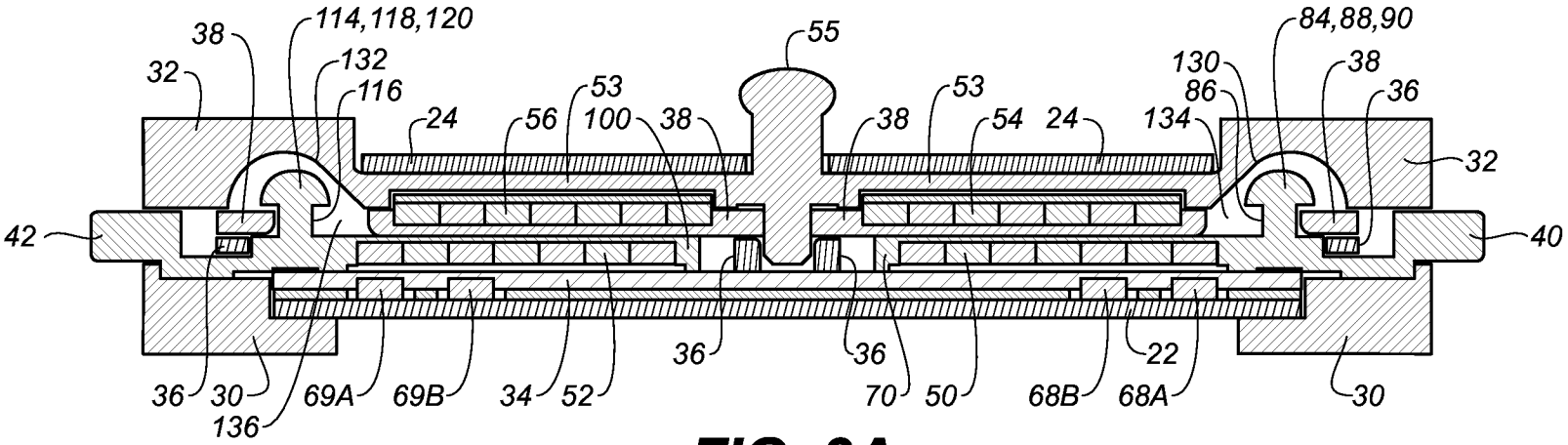
FIG. 3A illustrates a sectional view of the buckle taken along section lines 3A-3A of FIG. 2, in accordance with one embodiment of the present disclosure.
Figure 3B:
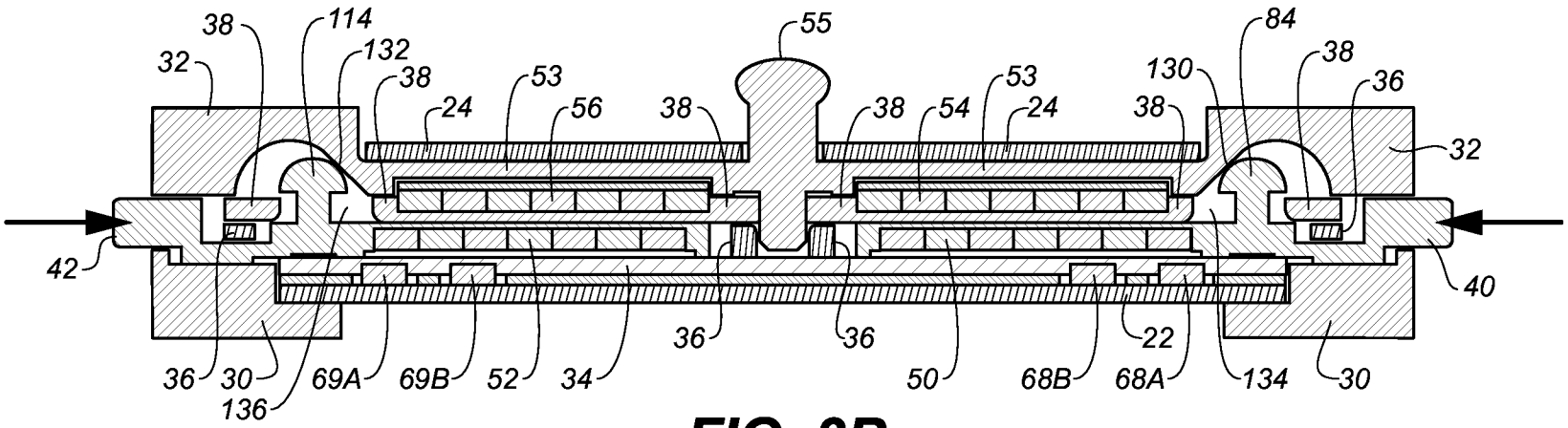
FIG. 3B illustrates a sectional view of the buckle of FIG. 3A when the buttons are pushed inwardly, in accordance with one embodiment of the present disclosure.
Figure 3D:
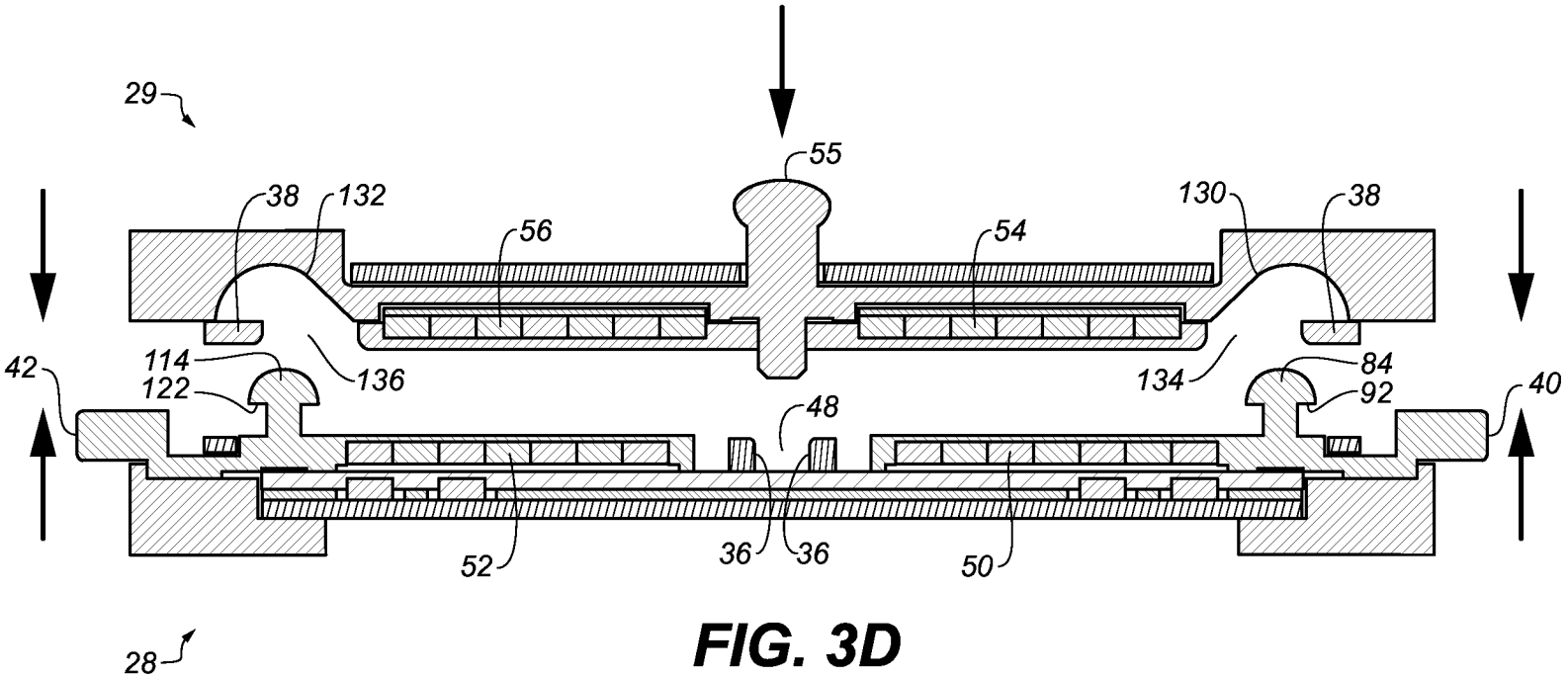
FIG. 3D illustrates a sectional view of the buckle of FIG. 3A when the top and bottom portions of the buckle are being joined, in accordance with one embodiment of the present disclosure.
Figure 3E:
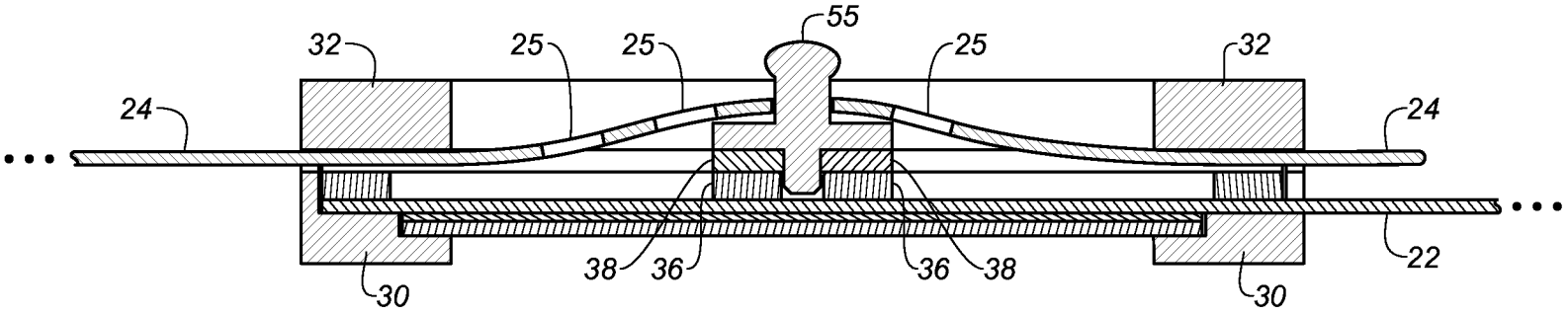
FIG. 3E illustrates a sectional view of the buckle taken along section lines 3E-3E of FIG. 2, in accordance with one embodiment of the present disclosure.
Figure 4:
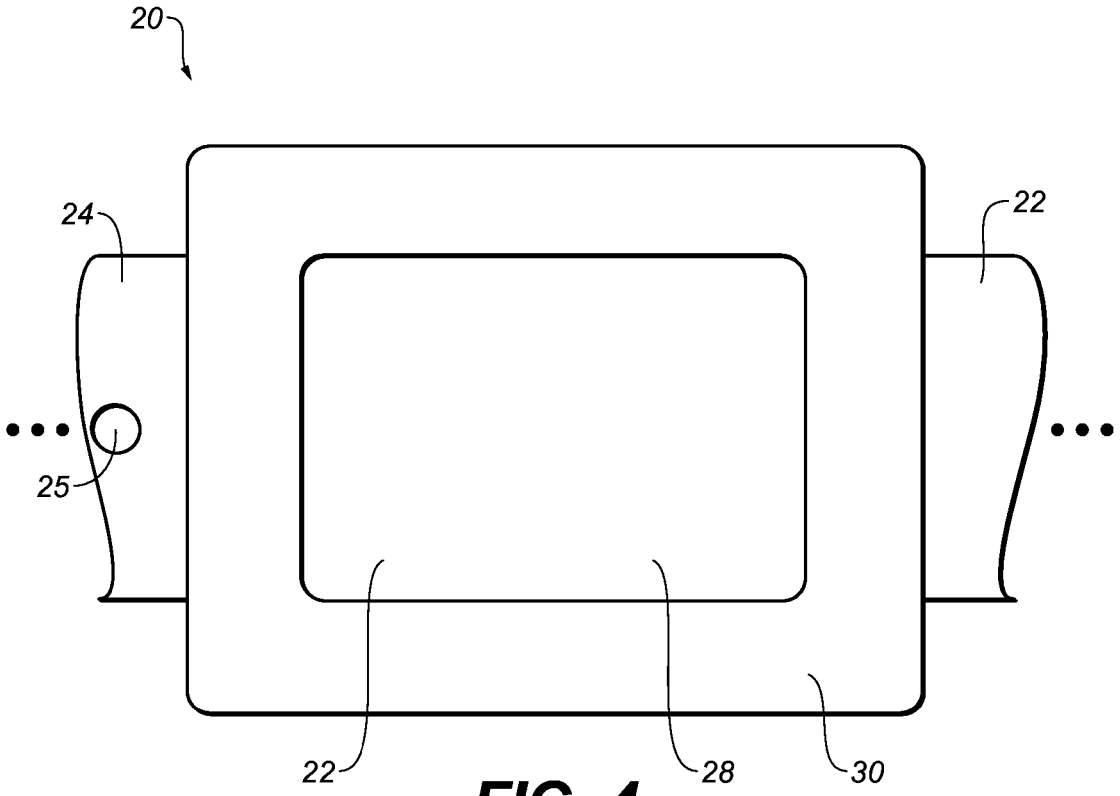
FIG. 4 illustrates a bottom view of the buckle, in accordance with one embodiment of the present disclosure.

Buckle 20 may have first and second portions. In one example, buckle 20 includes a first, bottom, outer portion 28 (FIG. 3D; FIG. 4) which is distal to a wearer's skin or clothing during use, and the buckle may also include a second, top, inner portion 29 (FIG. 2; FIG. 3D) which may be configured to contact the wearer's skin or clothing during use.

Figure 3C:
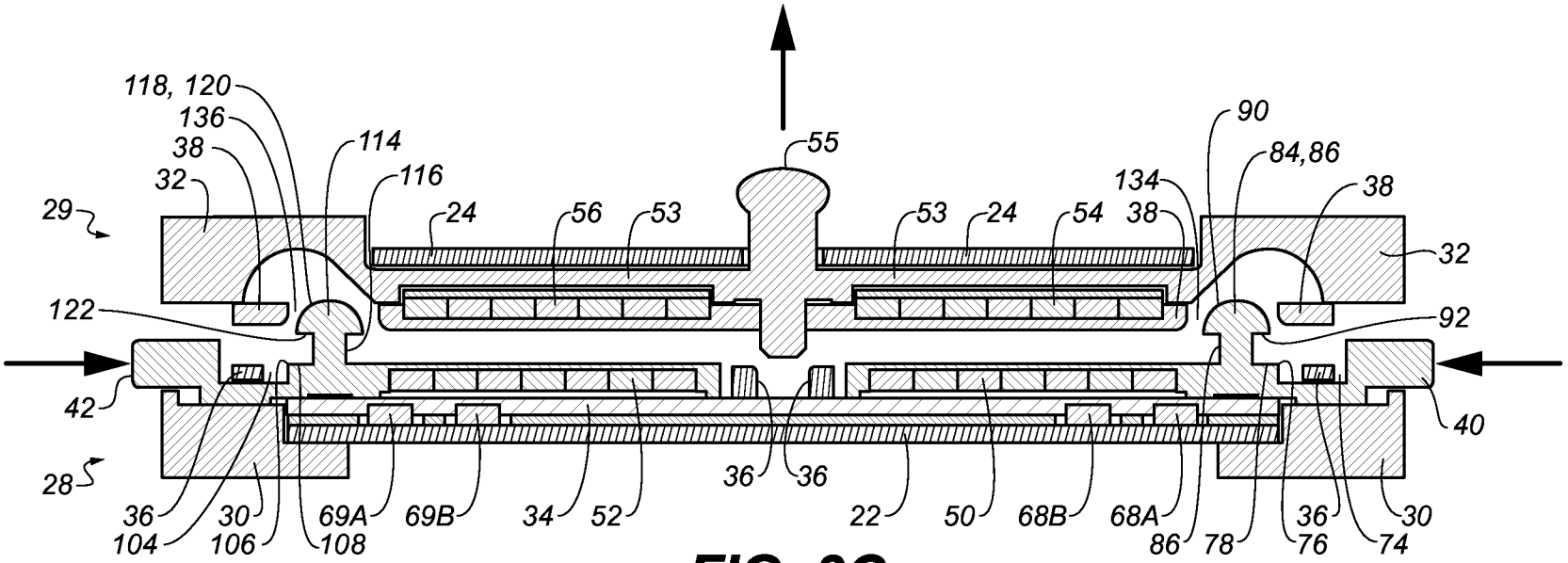
FIG. 3C illustrates a sectional view of the buckle of FIG. 3A when the top and bottom portions of the buckle are being separated, in accordance with one embodiment of the present disclosure.
Figure 5:
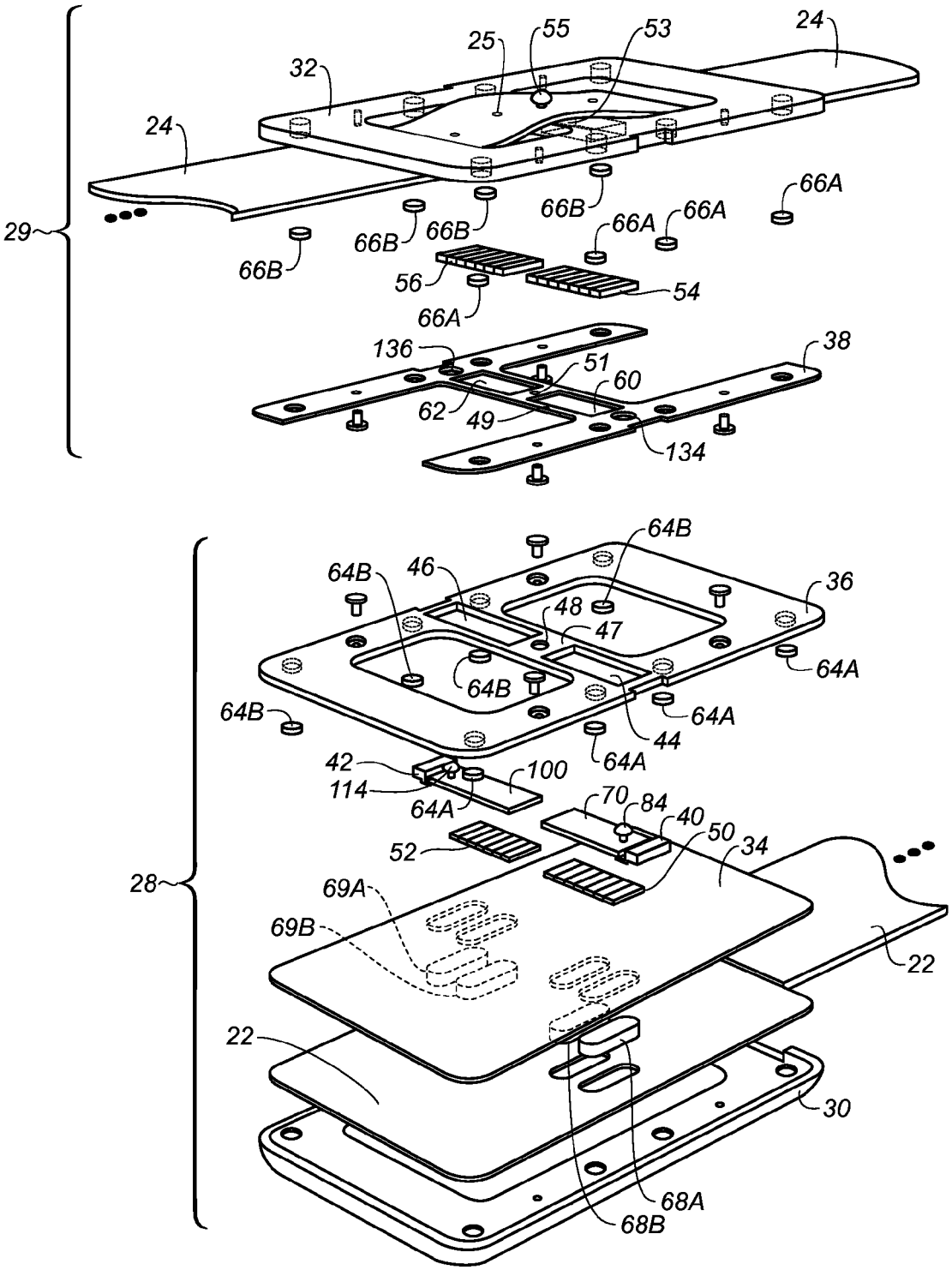
FIG. 5 illustrates an exploded view of the example buckle, in accordance with one embodiment of the present disclosure.

As described herein and shown in FIG. 3C, bottom portion 28 of buckle 20 may include, in one example, a first frame member 30, a fixed terminal portion of strap 22, plate 34, slide magnet arrays 50, 52, magnets 64A-B (shown in FIG. 5), buttons 40, 42, plate 36, and magnets 68A-B and 69A-B. Top portion 29 of buckle 20 may include, in one example, plate 38, slide magnet arrays 54, 56, magnets 66A-B (shown in FIG. 5), and the second frame member 32. The top portion 29 may be configured to receive strap 24, as shown in FIGS. 3C-3D and FIG. 5.

Referring to FIGS. 3A-3E and FIG. 5, buckle 20 may include a first frame member 30 and a second frame member 32 which house and contain various components of buckle 20 therebetween. In one example, the first frame member 30 may be generally rectangular in shape and may have a flat or slightly curved profile with a hollow center portion, or may take other shapes depending upon the implementation. A first plate 34 may be provided to secure strap 22 within the interior of the first frame member 30, and the first plate 34 may be sized such that it fits securely within the interior of frame member 30.

A second plate 36 may be coupled with frame members 30. In one example, the second plate 36 is secured (using rivets, bolts, screws or other conventional attachment structures) with the first frame member 30 to form the bottom portion 28 of the buckle. Plate 36 may be generally rectangular in shape with one or more hollow portions, and may have a flat or slightly curved profile, with a cross member 47 joining opposing sides of plate 36, or may take other shapes depending upon the implementation. As shown in FIG. 5, cross member 47 may have an indentation or opening 48 positioned about a center point along a top surface of the cross member, in one example. In some embodiments, opening 48 may receive a mating pin (not shown) that extends through the opening 48 on one or both sides. The mating pin may likewise be received in opening 51 (or another suitable aperture) when the two halves of the buckle (e.g., top or upper portion 29 and bottom or lower portion 28) are mated. The mating pin may facilitate alignment of the two halves with respect to one another. In some embodiments, one or more screws may serve a similar or the same purpose as the mating pin, while simultaneous holding pieces of the buckle together. As one non-limiting example, a screw may affix plate 34 to plate 36 and may partially protrude above the upper surface of plate 34 (as viewed in the orientation shown in FIG. 5). The protruding portion of such as screw may be received in a recess or aperture defined in either frame member 32 or plate 38, thereby facilitating alignment of the upper portion 29 and lower portion 28 when the two portions are near or mated to one another.

A third plate 38 may be coupled with frame member 32. Plate 38 may be sized such that it fits securely within the interior of frame member 32. In one example, the third plate 38 is secured (using rivets, bolts, screws or other conventional attachment structures) with the second frame member 32 to form the top portion 29 of the buckle. In one example, plate 38 may be generally H-shaped and may have a flat or slightly curved profile, with a cross member 49 joining opposing sides of plate 38, or may take other shapes depending upon the implementation. As shown in FIG. 5, cross member 49 may have an opening 51 positioned about a center point along the cross member 49, in one example.

The second frame member 32, in one example, may be generally rectangular in shape and may have a flat or slightly curved profile with one or more hollow portions, or may take other shapes depending upon the implementation. A cross member 53 may be provided joining opposing sides of frame member 32, in one example. A knob or other protrusion 55 may be provided in order to engage an opening 25 of strap 24, as shown in FIGS. 2, 3A-D and 5. Knob 55 may also include a downwardly orientated portion which is adapted to pass through opening 51 of plate 38, and which is adapted to be seated within indentation 48 of plate 36 when the lower and upper portions 28, 29 of buckle 20 are engaged together.

Strap 24 may be positioned and secured to frame member 32 by the user of the buckle 20. In one example, the user positions strap 24 into frame member 32 so as to select a desired length of strap 24 around the user's wrist, arm, leg, waist or other body part. Once strap 24 is secured into position and engaged with knob 55, in one example, the user does not have to continually disengage and re-engage strap 24 with knob 55 each time the user removes or applies the buckle the their body—instead, the user can release the buckle through the use of buttons 40, 42, and re-attach buckle 20 to their body using the magnetic properties of buckle 20 as described herein. In certain embodiments, knob 55 may be omitted or may not extend through a hole when the strap 24 passes through the frame member 32 and the user selects a desired length of the strap (and thus, snugness around the user's wrist or the like). Instead, friction and/or pressure between the frame member 32 and strap 24 may retain the strap in place even if the knob 55 is not present or is not passing through an opening 25 in the strap. In still further embodiments, the strap 24 may be mechanically retained with respect to the frame through a different mechanism, such as a snap-fit, clamshell, track or the like and the knob may thus be omitted. In the various embodiments permitting adjustment of the strap 24 with respect to the frame member 32, it should be appreciated that the strap may be positioned at any point along its length desired by a user and maintained in such a position regardless of the presence of the knob 55 or any holes 25.

A first button 40 and a second button 42 may be provided and position between plates 34, 36, in one example. Buttons 40, 42 may be axially aligned along or approximately along a centerline of buckle 20 in one example, and buttons 40, 42 may be positioned on opposing ends or opposing sides of buckle 20. Each button 40, 42 has a portion which extends or protrudes beyond the outer periphery of frame members 30, 32, such that a user can press or move the buttons 40, 42 inwardly with a user's fingers or thumbs in order to release and open buckle 20. In some embodiments the button 40, 42 may be flush with sides of the buckle 20 rather than protruding.

In one example, the second plate 36 includes, along cross member 47, a first opening 44 for receiving button 40, and a second opening 46 for receiving button 42. The openings 44, 46 may acts as guides for the lateral movement of buttons 40, 42 within the respective openings 44, 46.

Buckle 20 may include a first slide magnet array 50 and a second slide magnet array 52. In one example, slide magnet array 50 may be positioned within first button 40, and slide magnet array 52 may be positioned within second button 42.

In one example, slide magnet arrays 50, 52 may each contain a series of two or more magnets of alternating polarities. For instance, in the example shown in FIGS. 3A-3D, slide magnet arrays 50, 52 each include a series of seven magnets that alternate polarities (e.g., such that the upper surface polarities alternate between north and south in adjacent magnets, or vice versa). It should be appreciated that varying the number of magnets in each array may vary not only the magnetic flux between the arrays, but also the distance which one array may slide with respect to another before a repulsive force is exerted between the arrays. Generally, the more magnets in each array, the smaller the magnets are (assuming a fixed overall size for each array) and thus the less distance the arrays may travel with respect to one another before the arrays repulse one another instead of attracting one another.

As shown in FIGS. 3A-3D, slide magnet arrays 50, 52 can be moved inwardly and outwardly between plates 34, 36, wherein the movement of slide magnet arrays 50, 52 follows the lateral movement of buttons 40, 42, respectively.

Buckle 20 may also include a third magnet array 54 and a fourth magnet array 56 positioned in the top portion 29 of buckle 20. In one example, magnet arrays 54, 56 may be positioned in a fixed location along cross member 49 within recessed portions 60 and 62, respectively, of the third plate 38 (FIG. 5). In one example, magnet arrays 54, 56 may each contain a series of two or more magnets of alternating polarities. For instance, in the example shown in FIGS. 3A-3D, magnet arrays 54, 56 each includes a series of seven magnets, with alternating polarities such that the polarities of the magnet arrays 54, 56 generally match those of magnet arrays 50, 52, respectively. For example, if the upper surface of magnet array 50 generally alternate between north and south poles with the leftmost magnet having a north polarity on its upper surface, the same will be true of the magnet array 54. In this manner, the upper sets of magnet arrays 50, 52 may attract the lower sets of magnet arrays 54, 56 when the upper sets of magnets are positioned over the lower sets of magnets.

Magnet arrays 54, 56 interact with the slide magnet arrays 50, 52 depending on the position of slide magnet arrays 50, 52 and the corresponding attractive magnetic forces or repulsive magnetic forces between slide magnet arrays 50, 52 and magnet arrays 54, 56. These various interactions are described herein with reference to FIGS. 3A-3E.

In one example, buckle 20 may also include a plurality of magnets 64A-B positioned within the bottom portion 28, and magnets 66A-B positioned within the top portion 29 of buckle 20. Magnets 64A-B and 66A-B can be positioned within the respective and opposing corners of the lower and upper portions 28, 29 of the buckle. The polarities of the magnets can be selected so as to provide an attractive magnetic force between the lower and upper portions 28, 29 of buckle 20, in one example.

In one example, the lower portion 28 may include one or more magnets 68A-B positioned below slide magnet array 50; and lower portion 28 may also include one or more magnets 69A-B positioned below slide magnet array 52. In one example and as shown in FIG. 5, the terminal end of strap 22 may include slots to receive magnets 68A-B, 69A-B.

Magnet(s) 68A-B provide a biasing magnetic force upon slide magnet array 50 that holds button 40 in a default or normal position, until a time when a user depresses button 40 inwardly in a manner that overcomes the biasing magnetic force. In one example as shown in FIG. 3A, the default or initial position of button 40 can be where button 40 is in an outermost position relative to frame member 30. Once a user releases button 40, the biasing magnetic force of magnets 68A-B upon slide magnet array 50 can operate to return button 40 to its normal, default outmost position shown in FIG. 3A, in one example.

Magnet(s) 69A-B provide a biasing magnetic force upon slide magnet array 52 that holds button 42 in a default or normal position, until a time when a user depresses button 42 inwardly in a manner that overcomes the biasing magnetic force. In one example as shown in FIG. 3A, the default or initial position of button 42 can be where button 42 is in an outermost position relative to frame member 30. Once a user releases button 42, the biasing magnetic force of magnets 69A-B upon slide magnet array 52 can operate to return button 42 to its normal, default outmost position shown in FIG. 3A, in one example.

In one example and as shown in FIGS. 3C and 5, button 40 has an elongated portion 70 with a slot configured to receive slide magnet array 50. Button 40 may include a recess 74 defining an edge 76 and a shelf 78. In one example, a protrusion 84 is positioned along shelf 78, and protrusion 84 may include a shaft 86 and a head 88, which in one example may be a half-sphere that defines a curved outer surface 90 and a flat inner bearing surface 92.

Likewise, as shown in the example of FIGS. 3C and 5, button 42 has an elongated portion 100 with a slot configured to receive slide magnet array 52. Button 42 may include a recess 104 defining an edge 106 and a shelf 108. In one example, a protrusion 114 is positioned along shelf 108, and protrusion 114 may include a shaft 116 and a head 118, which in one example may be a half-sphere that defines a curved outer surface 120, and a flat inner bearing surface 122.

In one example and as shown in FIGS. 3A-3D, frame member 32 has two curved inner surfaces 130, 132, each adapted to engage and guide the protrusions 84, 114 respectively, when the user presses buttons 40, 42 inwardly, as described herein.

In one example and as shown in FIGS. 3A-3D and 5, plate 38 has holes 134, 136 sized so that protrusions 84, 114 respectively can pass through holes 134, 136. When bottom and top portions 28, 29 of buckle 20 are connected together, protrusions 84, 114 engage the outer top edge of each hole 134, 136.

One example of operations of buckle 20 will now be described, in accordance with one embodiment of the present disclosure.

In FIG. 3A, when the bottom and top portions 28, 29 of buckle 20 are connected together in a closed state, slide magnet array 50 is positioned relative to magnet array 54 such that magnets of the same polarities (with respect to the same orientation) are in vertical alignment or substantial vertical alignment, which creates a magnetic attractive force between magnet arrays 50 and 54 which has the effect to hold together the bottom and top portions 28, 29 of buckle 20.

Likewise, when buckle 20 is in a closed state, slide magnet array 52 is positioned relative to magnet array 56 such that magnets of the same polarities (with respect to the same orientation) are in vertical alignment or substantial vertical alignment, which also creates a magnetic attractive force between magnet arrays 52 and 56 which has an effect to hold together the bottom and top portions 28, 29 of buckle 20. This magnetic attractive force is additive to the magnetic attractive force created between magnet arrays 50 and 54.

In addition, when buckle 20 is in a closed state, lower magnets 64A-B and upper magnets 66A-B are in alignment, which creates an attractive magnetic force between magnets 64A-B and 66A-B. This, in turn, holds together the bottom and top portions 28, 29 of buckle 20. This magnetic attractive force is additive to the magnetic attractive force created between magnet arrays 50 and 54, and magnet arrays 52 and 56.

Also, as described above, magnets 68A-B exert an attractive magnetic force upon slide magnet array 50 which outwardly biases the position of button 40, as shown in FIG. 3A. Similarly, magnets 69A-B exert an attractive magnetic force upon slide magnet array 52 which outwardly biases the position of button 42, as shown in FIG. 3A.

As shown in FIG. 3B, when the user wishes to open the buckle and therefore separate bottom and top portions 28, 29 of buckle 20, the user depresses buttons 40, 42 inwardly. The force of the user's inward depressions of buttons 40, 42 overcomes the outward biasing magnetic force of magnets 68A-B on slide magnet array 50 and also overcomes the outward biasing magnetic force of magnets 69A-B on slide magnet array 52. Therefore, the button 40 and slide magnet array 50 move inwardly, as does button 42 and slide magnet array 52.

When the buttons 40, 42 are pressed inwardly, slide magnet array 50 and magnet array 54 are positioned such that magnets of opposing polarities (e.g., the facing surfaces of vertically-aligned magnets have the same polarity) from arrays 50, 54 move into vertical alignment or substantial vertical alignment, which creates a magnetic repulsion force between magnet arrays 50 and 54 which has an effect to move the bottom and top portions 28, 29 of buckle 20 away and apart from one another.

Likewise, when the buttons 40, 42 are pressed inwardly, slide magnet array 52 and magnet array 56 are positioned such that magnets of opposing polarities (e.g., the facing surfaces of vertically-aligned magnets have the same polarity) from 52, 56 move into vertical alignment or substantial vertical alignment, which also creates a magnetic repulsive force between magnet arrays 52 and 56 which has an effect to move the bottom and top portions 28, 29 of buckle 20 away and apart from one another. This magnetic repulsive force is additive to the magnetic repulsive force created between magnet arrays 50 and 54.

In one example, the sum of the magnetic repulsive forces between magnet arrays 50 and 54, and 52 and 56, overcomes the magnetic attractive forces of the lower magnets 64A-B and upper magnets 66A-B. Moreover, as buttons 40, 42 are moved inwardly, the protrusions 84 and 114 engage surfaces 130, 132 of upper frame member 32, which exerts contact forces which separate the bottom and top portions 28, 29 of buckle 20. Hence, the user's depressions of buttons 40, 42 may separate lower and upper portions of buckle 20, which thereby opens buckle 20.

Although the configuration, interplay and operation of buttons 40, 42 have been described in detail, it should be appreciated that other structures may be used in place of one or both buttons, and that one button alone may be used. For example, a post, protrusion, or other structure may slide, twist, tilt, move outwardly or diagonally, or otherwise move to reposition the magnet arrays 52, 56 (or other magnets) in order to open the buckle. Such motion may lever the buckle open, as another example. As yet another example, the frame members 30, 32 may slide, twist, or otherwise move with respect to one another to realign the magnets and/or undo a mechanical detent or other locking feature in order to open the buckle.

Once the buckle 20 is in an open state, as shown in FIG. 3D, magnets 68A-B again exert an attractive magnetic force upon slide magnet array 50 which biases the position of button 40 outwardly. Similarly, magnets 69A-B exert an attractive magnetic force upon slide magnet array 52 which biases the position of button 42 outwardly.

As the user brings the lower and upper portions 28, 29 of buckle 20 together in close proximity, lower magnets 64A-B and upper magnets 66A-B create an attractive magnetic force therebetween, which has an effect to attract the bottom and top portions 28, 29 of buckle 20

Also, slide magnet arrays 50 and 54 create a magnetic attractive force between the magnet arrays 50 and 54 (and more specifically, the individual magnets in each array) which has the effect to bring together the bottom and top portions 28, 29 of buckle 20. Likewise, slide magnet arrays 52 and 56 also create a magnetic attractive force which has an effect to bring together the bottom and top portions 28, 29 of buckle 20.

As shown in FIG. 3D, as bottom and top portions 28, 29 of buckle 20 are brought together, the top surface of protrusions 84, 114 engage or latch to the perimeter walls of holes 134, 136 respectively of plate 38, which moves buttons 40, 42 inwardly momentarily. The downward portion of knob 55 is guided into indentation 48 of plate 36, which helps guide bottom and top portions 28, 29 of buckle 20 together. In this manner, bearing surfaces 92, 122 of protrusions 84, 114 respectively engage and latch to the walls of holes 134, 136, and the buckle is again in a closed state as shown in FIG. 3A.

Hence, it can be seen that a buckle can be formed using one or more features described herein, wherein once the straps attached to the buckle are set by the user with respect to length, the user can open and close the buckle without having to continually adjust the length of the straps attached to the buckle.

While embodiments of the present disclosure have been described with reference to strap 24 being positioned toward the user's skin or body, it is understood that embodiments of the present disclosure can be formed wherein straps 22 and 24 can be inverted, and bottom, outer portion 28 and top, inner portion 29 can be inverted, if desired.

Also, frame members 30, 32 and plates 34, 36, 38 can be curved (i.e., concave or other accurate shape) in order to adapt the buckle 20 to its desired use, for instance to be attached to a wearer's arm or other body part.

While embodiments of the disclosure have been described with reference to a wearable device, it is understood that embodiments of the present disclosure can be utilized with a variety of electronic devices including but not limited to mobile devices, mobile phones, tablet computers, music and multi-media players, watches, gaming devices, and other handheld, wearable or portable devices. Likewise, embodiments described herein may be used as closures for a bag, luggage, briefcase and the like. Embodiments may be used to attach a device to a stand or holder or clothing rather than about a user's wrist, limb or body part. Embodiments may likewise attach an accessory, peripheral or other device to another device, for example serving to attach a media player to a computer or the like.

While the methods disclosed herein have been described and shown with reference to particular operations performed in a particular order, it will be understood that these operations may be combined, sub-divided, or re-ordered to form equivalent methods without departing from the teachings of the present disclosure. Accordingly, unless specifically indicated herein, the order and grouping of the operations is not a limitation of the present disclosure.

It is understood that the directional references provided herein, such as top, bottom, upwards, downwards, clockwise, counterclockwise, left, right, and the like, are provided to describe examples of the embodiments disclosed herein, and are not intended to be limiting.

It should be appreciated that in the foregoing description of exemplary embodiments of the disclosure, various features of the disclosure are sometimes grouped together in a single embodiment, figure, or description thereof for the purpose of streamlining the disclosure and aiding in the understanding of one or more of the various aspects. This method of disclosure, however, is not to be interpreted as reflecting an intention that the claims require more features than are expressly recited in each claim. Rather, inventive aspects lie in less than all features of a single foregoing disclosed embodiment, and each embodiment described herein may contain more than one inventive feature.

While the disclosure is presented and described with reference to embodiments thereof, it will be understood by those skilled in the art that various other changes in the form and details may be made without departing from the spirit and scope of the disclosure.

We claim:

1. A clasp for securing a first strap with a second strap, comprising:

a first clasp portion;

a first set of magnets movable within the first clasp portion between a first position and a second position, the first clasp portion adapted to be attached with the first strap;

a second clasp portion adapted to selectively connect with the first clasp portion; and a second set of magnets positioned within the second clasp portion and adjacent the first set of magnets when the second clasp portion is connected with the first clasp portion, the second clasp portion adapted to be attached with the second strap;

wherein, when the first set of magnets is in the first position, the first and second set of magnets create an attractive magnetic force therebetween.

2. The clasp of claim 1, wherein when the first set of magnets is in the second position, the first and second set of magnets create a repulsive magnetic force therebetween.

3. The clasp of claim 1, further comprising:

at least one biasing magnet positioned within the first clasp portion adjacent to the first set of magnets, wherein the biasing magnet creates an additional attractive magnetic force that biases the first set of magnets into said first position.

4. The clasp of claim 1, wherein the first set of magnets includes a plurality of magnets of alternating polarities positioned adjacent to one another.

5. The clasp of claim 1, wherein the second set of magnets includes a plurality of magnets of alternating polarities positioned adjacent to one another.

6. The clasp of claim 1, further comprising:

at least one button member positioned within the first clasp portion, the button member adapted to receive contact from a user.

7. The clasp of claim 6, wherein the at least one button member includes a latch that selectively secures to a portion of the second clasp portion.

8. The clasp of claim 6, wherein the first set of magnets is positioned within the at least one button member.

9. The clasp of claim 1, further comprising:

a first set of corner magnets positioned within the first clasp portion; and a second set of corner magnets positioned within the second clasp portion in a position that such that when the first and second clasp portions are connected together, the first and second set of corner magnets create an additional attractive magnetic force therebetween.

10. The clasp of claim 9, wherein when the first set of magnets is in the second position, the first and second set of magnets create a repulsive magnetic force therebetween that is greater than said additional attractive magnetic force between the first and second set of corner magnets.

11. The clasp of claim 1, wherein the first and second straps are connected with a wearable electronic device.

12. A buckle, comprising:

a first buckle portion having a first set of magnets positioned within the first buckle portion; and a second buckle portion having a second set of magnets positioned within the second buckle portion, wherein the first and second set of magnets are adapted to attract the first and second buckle portions together via an attractive magnetic force;

wherein the first buckle portion also includes one or more slideable magnets movable between at least a first position and a second position;

wherein the second buckle portion also includes one or more magnets in a fixed location within the second buckle portion, the one or more magnets adapted to magnetically interact with the one or more slideable magnets of the first buckle portion.

13. The buckle of claim 12, wherein when the slideable magnets are in the first position, there is an additional attractive magnetic force between the slideable magnets and the one or more magnets in the fixed location within the second buckle portion.

14. The buckle of claim 12, wherein when the slideable magnets are in the second position, there is a repulsive magnetic force between the slideable magnets and the one or more magnets in the fixed location within the second buckle portion.

15. The buckle of claim 14, wherein the repulsive magnetic force is greater than the attractive magnetic force, thereby permitting the first and second buckle portions to be physically separated.

16. The buckle of claim 12, further comprising: at least one biasing magnet positioned within the first buckle portion adjacent to the one or more slideable magnets, wherein the biasing magnet creates a magnetic force that biases the slideable magnets into said first position.

17. The buckle of claim 12, wherein the first buckle portion is adapted to be attached with a first strap; and the second buckle portion is adapted to be attached with a second strap.

18. A method of forming a buckle, comprising:

forming a first buckle portion with a first set of magnets movable within the first buckle portion between a first position and a second position;

forming a second buckle portion with a second set of magnets positioned in a fixed location within the second buckle portion; and biasing the first set of magnets toward the first position, such that when the first set of magnets is in the first position, the first and second set of magnets create a first attractive magnetic force therebetween.

19. The method of claim 18, further comprising:

positioning a third set of magnets in the first buckle portion;

positioning a fourth set of magnets in the second buckle portion;

wherein the third and fourth set of magnets create a second attractive magnetic force between the first and second buckle portions.

20. The method of claim 19, wherein when the first set of magnets is in the second position, a repulsive magnetic force is created between the first set of magnets and the second set of magnets, the repulsive magnetic force being greater than the second attractive magnetic force.

* * * * *